US006899792B2

(12) United States Patent
Hallberg

(10) Patent No.: US 6,899,792 B2
(45) Date of Patent: May 31, 2005

(54) METHOD AND A DEVICE FOR REMOVING WATER FROM THE SURFACE OF A ROLLER JACKET

(75) Inventor: Peter Hallberg, Karlstad (SE)

(73) Assignee: Metso Paper Inc., Helsinki (FI)

( * ) Notice: Subject to any disclaimer, the term of this patent is extended or adjusted under 35 U.S.C. 154(b) by 0 days.

(21) Appl. No.: 10/433,594

(22) PCT Filed: Dec. 7, 2001

(86) PCT No.: PCT/SE01/02715

§ 371 (c)(1),
(2), (4) Date: Jun. 4, 2003

(87) PCT Pub. No.: WO02/46524

PCT Pub. Date: Jun. 13, 2002

(65) Prior Publication Data

US 2004/0050519 A1 Mar. 18, 2004

Related U.S. Application Data

(60) Provisional application No. 60/273,368, filed on Mar. 5, 2001.

(30) Foreign Application Priority Data

Dec. 8, 2000 (SE) ..... 0004524

(51) Int. Cl.[7] ..... D21F 1/34; D21F 3/00

(52) U.S. Cl. ..... 162/199; 162/272; 162/358.3; 162/DIG. 7; 134/33; 134/104.2; 134/198

(58) Field of Search ..... 162/199, 272, 162/280–282, 195, 189, 274–279, 358.1, 358.3, DIG. 7; 15/256.5, 256.51; 100/37, 112, 119, 121; 101/423, 425; 134/33, 172, 198, 104.2; 118/413

(56) References Cited

U.S. PATENT DOCUMENTS

| | | | | | |
|---|---|---|---|---|---|
| 3,198,694 | A | * | 8/1965 | Justus | 162/358.1 |
| 5,755,931 | A | * | 5/1998 | Schiel | 162/206 |
| 5,819,660 | A | * | 10/1998 | Gegenheimer et al. | 101/425 |
| 5,848,452 | A | * | 12/1998 | Lappalainen et al. | 15/256.51 |
| 5,944,956 | A | * | 8/1999 | Marcheggiani | 162/199 |
| 5,964,960 | A | | 10/1999 | Boeck | |
| 6,468,397 | B1 | * | 10/2002 | Chuang | 162/199 |
| 6,746,575 | B1 | * | 6/2004 | Juvakka et al. | 162/272 |

FOREIGN PATENT DOCUMENTS

| | | | | |
|---|---|---|---|---|
| DE | 19810800 | * | 9/1999 | D21F/3/02 |
| WO | WO 98/27279 | * | 6/1998 | D21G/3/00 |

* cited by examiner

*Primary Examiner*—Steven P. Griffin
*Assistant Examiner*—Eric Hug
(74) *Attorney, Agent, or Firm*—Alston & Bird LLP

(57) ABSTRACT

The present invention relates to a method for removing water from a movable roll jacket surface in a wet section of a paper-making machine, which roll jacket surface preferably belongs to a flexible roll jacket in a shoe press, said method comprising the following steps: arranging a spray device next to the roll jacket surface, making available a collecting device which is provided with an opening and collects liquid, moving said roll jacket surface past said spray device, applying a medium onto said roll jacket surface with the aid of said spray device, and collecting liquid in said liquid-collecting device. The invention is characterized in that said medium is sprayed with high kinetic energy onto said roll jacket surface to follow a fluid stream rebounding from the roll jacket surface, so that the liquid is conveyed to said liquid-collecting device.

35 Claims, 5 Drawing Sheets

METHOD AND A DEVICE FOR REMOVING WATER FROM THE SURFACE OF A ROLLER JACKET

This application claims the benefit of Provisional application Ser. No. 60/273,367, filed Nov. 5, 2001.

BACKGROUND OF THE INVENTION

1. Field of the Invention

The present invention relates to a method for removing water from a movable roll jacket surface in a wet section of a paper-making machine, which roll jacket surface preferably belongs to a flexible roll jacket in a shoe press, said method comprising the following steps:

arranging a spray device next to the roll jacket surface, setting up a collecting device which is provided with an opening and collects liquid, moving said roll jacket surface past said spray device, applying a medium onto said roll jacket surface with the aid of said spray device, and collecting liquid in said liquid-collecting device or liquid-receiving device.

2. Description of Related Art

In a wet section of a paper-making machine, large quantities of water have to be removed from the fiber web. This is done with, inter alia, the aid of pairs of rolls which form a nip for pressing/sucking water out of the fiber web. A certain amount of water remains behind on the roll jacket surface after the nip. In many situations it is desirable to remove at least the majority of the remaining water before that part of the roll jacket surface passes through the nip again.

It is already known, for example from U.S. Pat. Nos. 4,852,209 and 5,810,974, to set up spray devices which can clean (and/or cool) a roll jacket surface. However, this known technique does not deal with the problem of how to remove water from the roll jacket surface.

A press device in a wet section is already known from EP 771,903, where the roll jacket surface of one of the roll pairs is sprayed with water, after which a special scraping device (called a doctor blade) removes water from the roll jacket surface. DE 19860735 shows that it is also already known to arrange a scraping device/doctor blade solely for the purpose of removing water, i.e. without first spraying the roll jacket surface. Similar cleaning and dewatering devices are also already known from U.S. Pat. No. 5,520,782, DE 19841637, DE 19860735 and DE 19810800.

However, it is not always desirable to use a scraping member which is in direct contact with the roll jacket surface. In the case of a shoe press roll, where a flexible roll jacket is used, it may be particularly undesirable because the flexible roll jacket is often relatively sensitive and expensive.

There is a risk that such a scraping member may destroy the flexible roll jacket or at least accelerate its wear, in the same way that it can also cause damage on another type of roll surface.

A further disadvantage of known dewatering devices according to the above is that they have a very limited effect if the roll jacket surface from which water is to be removed is patterned, i.e. provided with grooves, for example of the type described in U.S. Pat. No. 4,559,258.

BRIEF SUMMARY OF THE INVENTION

It is an object of the present invention to eliminate or at least minimize the above-mentioned problems, and this is done by a method according to the above which is characterized in that a liquid medium is sprayed with high kinetic energy onto said roll jacket surface, in that the high-kinetic fluid thus forces liquid present on the roll jacket surface to follow a fluid stream rebounding from the roll jacket surface, so that the liquid is conveyed to said liquid-collecting device.

By virtue of the solution according to the invention, a method is obtained which eliminates or at least minimizes the risk of the roll jacket surface, from which water is to be removed, becoming damaged or worn, since there is no direct physical contact between the roll jacket surface and the dewatering device. In addition, the dewatering and cleaning (if required) are combined in one and the same step. A further important advantage is that it has a good dewatering effect (or cleaning effect) irrespective of whether the roll jacket surface is smooth or patterned.

According to another aspect of the invention, said medium is water.

By using water as the medium, high kinetic energy is obtained in a favorable manner in the stream of medium used for removing water from the roll jacket surface. Tests have shown that a surprisingly good effect can be obtained using this medium.

According to another aspect of the invention, said medium is sprayed onto the roll jacket surface at a certain spray angle ($\alpha$) in relation to the normal (N) o£ the roll jacket surface, so that an oriented and rebounding fluid stream is created, where $\alpha$ is between 5 and 85° and is a function of the speed ($v$) of the roll jacket surface, the spray angle ($\alpha$) increasing as the speed increases. By virtue of using an acute angle in relation to the roll jacket surface when applying the medium, it is possible to obtain a controlled rebound of the water which is removed from the roll jacket surface.

According to another aspect of the invention, the liquid-collecting device is provided with a lip element which is positioned in the rebounding fluid stream in order to convey the liquid onwards towards the liquid-collecting device. By virtue of the arrangement of a lip element, the rebounding stream of medium can be collected in a simple and flexible manner and conveyed to the collecting device.

According to another aspect of the invention, said roll jacket surface has irregularities in the form of grooves or cavities in which liquid can gather. By virtue of the invention, it has been found that it is also possible to remove water from patterned roll jacket surfaces in an extremely effective way, something which could not be done satisfactorily by previously known methods, especially not without the risk of damage or undesired wear.

The invention also relates to a device having the same features and advantages as the method. This, along with further advantages of the invention, is set out in the description below.

BRIEF DESCRIPTION OF THE SEVERAL VIEWS OF THE DRAWING(S)

The invention is explained in more detail below with reference to the attached figures, of which:

DETAILED DESCRIPTION OF THE INVENTION

Figure 1:
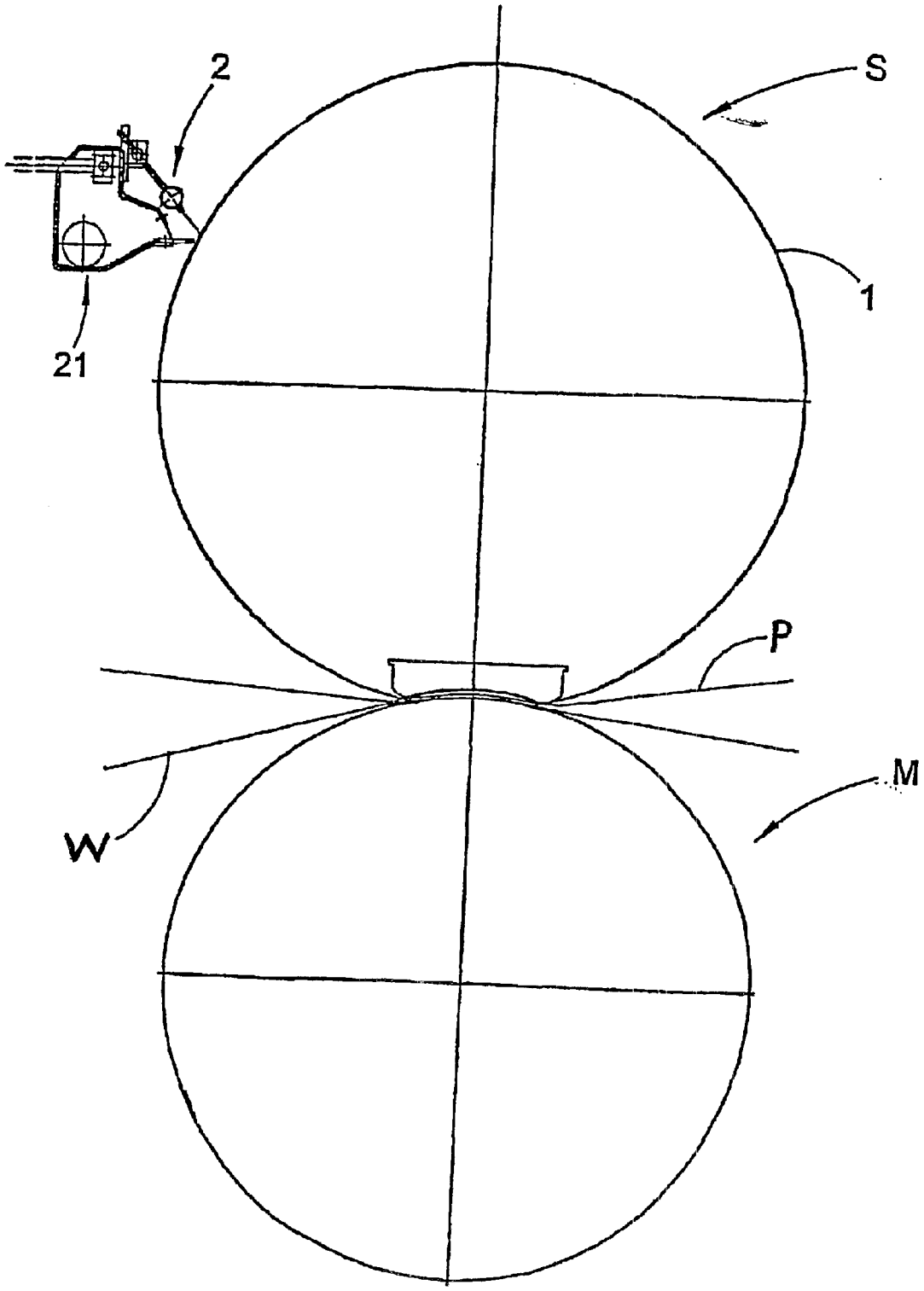
FIG. 1 is a schematic view of a shoe press with a device for removing water according to the invention.

FIG. 1 is a schematic representation of a shoe press roll S which is included in a paper-making machine and which cooperates with a counter roll M so that an extended nip for a fiber web W and press felt P is formed between them. A flexible roll jacket 1 is arranged in a known manner so that it encloses the shoe press roll S. A device for removing water according to the invention, with a spray device 2 and a liquid-collecting container 21, is arranged to remove water from the flexible roll jacket 1.

Figure 2:
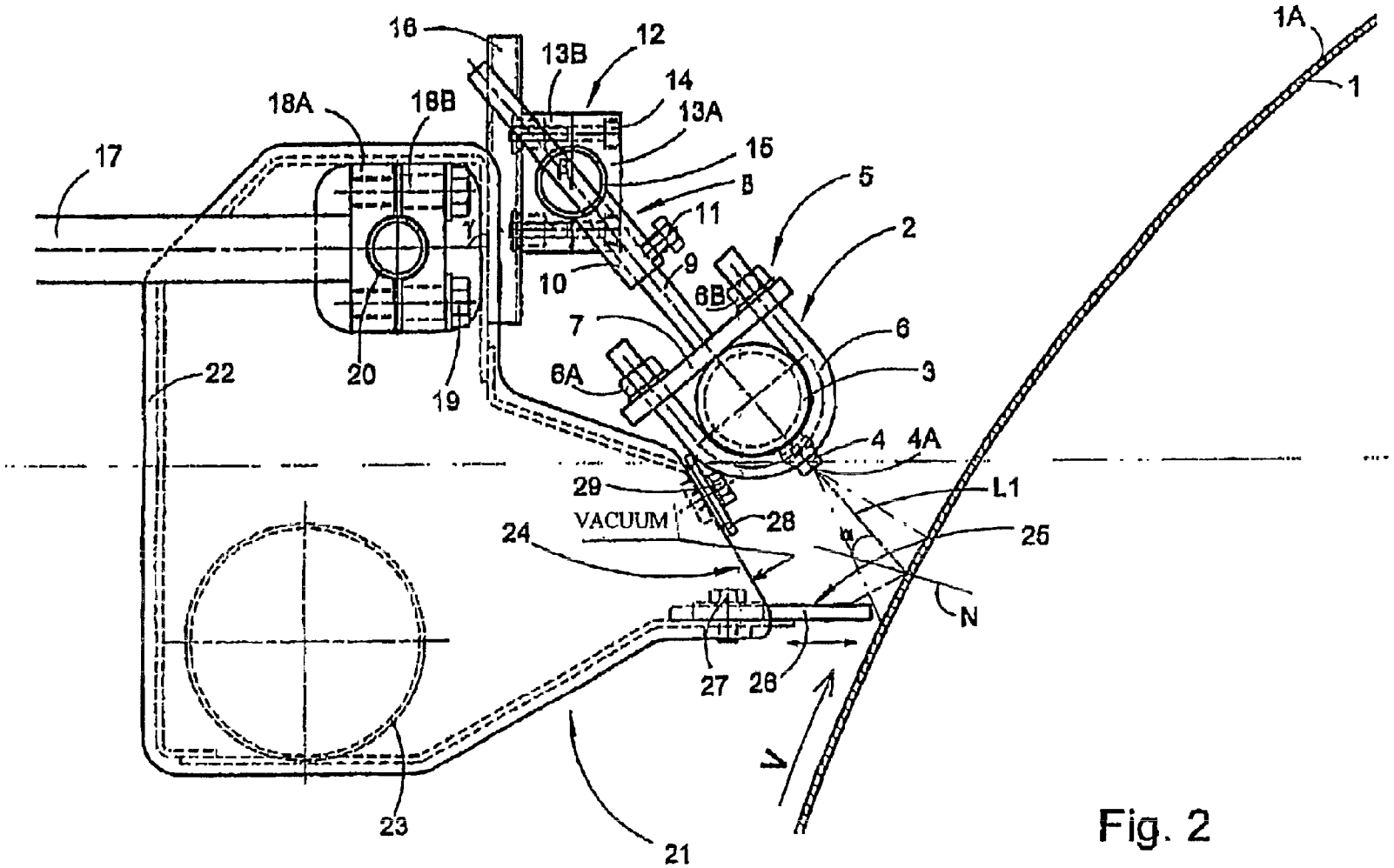
FIG. 2 shows a side view of a preferred embodiment of a device for removing water according to the invention.

FIG. 2 is a side view of a preferred embodiment of a device for removing water according to the invention. It will be seen that the device for removing water is arranged close to the roll jacket surface 1A of a flexible roll jacket 1 which moves upwards at a defined speed (v) past the device for removing water. The liquid-collecting device or liquid-receiving device 21 comprises an elongate container 22 (see also FIG. 3) with an axially elongate opening 24 directed towards the roll jacket surface 1A. The opening 24 thus extends parallel to the axial extent of the shoe press roll S around which the flexible, roll jacket 1 rotates. With the aid of clamp connections 18A, 18B, the collecting container 22 is adjustably mounted on a circular support part 20 which in turn is connected securely to a support 17 which is fixed in relation to the paper-making machine. With the aid of screw connections 19, the clamp connections 18A, 18B can be released/secured in order to obtain the desired positioning of the container 22 in relation to the support part 17, 20.

On top of the container 22 there are bracket elements 16 on which a first adjustable fastening device 8 for the spray device 2 is arranged. This first fastening device 8 makes it possible, on the one hand, to adjust the angle β and on the other hand to adjust the distance between the spray device 2 and the roll jacket surface 1A. In order to change the angle β, there is a clamp connection 13A, 13B which is fixed on said bracket 16. This clamp connection 13A, 13B cooperates with a sleeve 15 which can be locked at a certain angular position inside the clamp connection by means of screw connection 14. Welded onto said sleeve 15 there is an outer pipe-shaped part 10 which cooperates in a telescopic manner with a rod 9. With the aid of a locking screw 11, the rod 9 can be locked in different positions, i.e. displaced to different positions inside the outer pipe-shaped part 10. A plate 7 is arranged at one end of the rod 9. This plate 7 constitutes a rear support for a spray pipe 3. The spray pipe 3 is clamped securely against the support plate 7 with the aid of a conventional pipe clamp 6 which is locked on the plate 7 with the aid of nuts 6A, 6B. Arranged on the spray pipe 3 there are a number of spray nozzles 4 which each have a mouth 4A directed towards the roll jacket surface 1A.

Arranged near the lower edge of the opening 24 of the collecting container 22 there is a lip element 26 which projects in the direction towards the roll jacket surface 1A. With the aid of a screw connection 27, the lip element 26 is mounted adjustably on the container 22 so that the gap between the roll jacket surface 1A and the front edge of the lip can be adjusted. At the upper edge of the opening too, and secured by means of a screw connection 29, there is an adjustable lip-like device 28. The purpose of this last-mentioned device is to vary the size of the opening 24 in order to be able to obtain approximately the same vacuum, which is thus produced by varying the opening vertically along the container. The container 22 is connected at one end to an outlet 23 (see FIG. 3) connected to an outlet which is under vacuum or communicates with a vacuum source so that liquid can be actively sucked in through the opening 24 of the container 22. By means of the fact that the size of the opening can be varied along the container, an identical vacuum can be obtained along the container opening 24.

Figure 3:
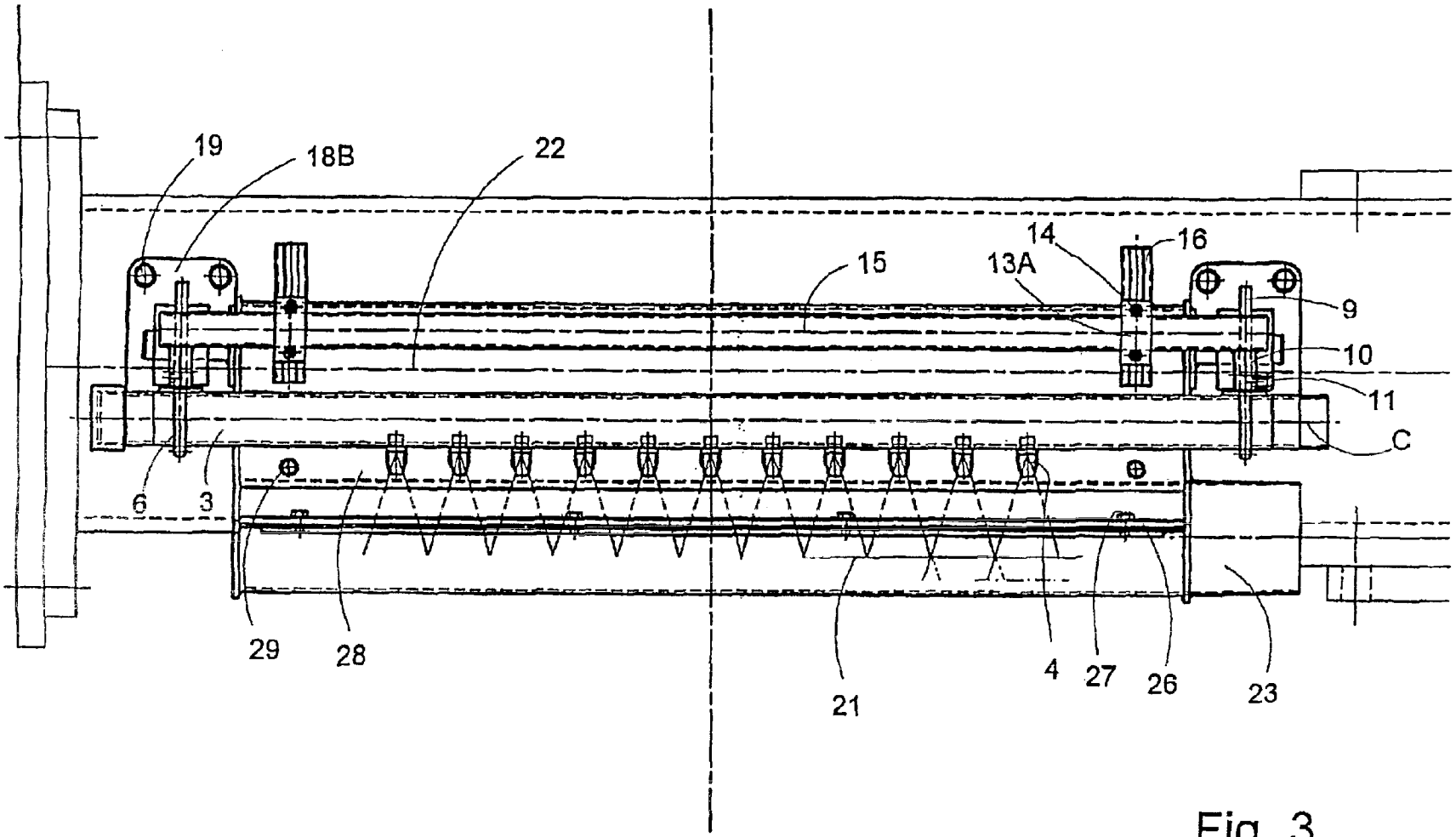
FIG. 3 shows a front view of the device according to FIG. 2.

FIG. 3 shows the device according to the invention in a front view, i.e. seen from the direction where the roll jacket surface 1A is placed. Most of the details shown in FIG. 3 are already clear from FIG. 2 and from the above description. However, FIG. 3 shows that the spray pipe 3 is elongate and that a large number of spray nozzles 4 are arranged alongside each other along the spray pipe 3. It will also be seen that each spray nozzle 4 has a mouth 4A, which in one direction emits a diverging jet (see FIG. 4). It will also be seen that the outlet 23 is arranged at one end of the collecting device 21, which is the reason for the arrangement of an adjustable upper lip 28, so that the distance between the lower edge of this lip 28 and the lower surface 26 of the mouth 24 can be varied in the vertical direction along the container. In this way, an identical vacuum can be obtained along the whole mouth 24.

Figure 4:
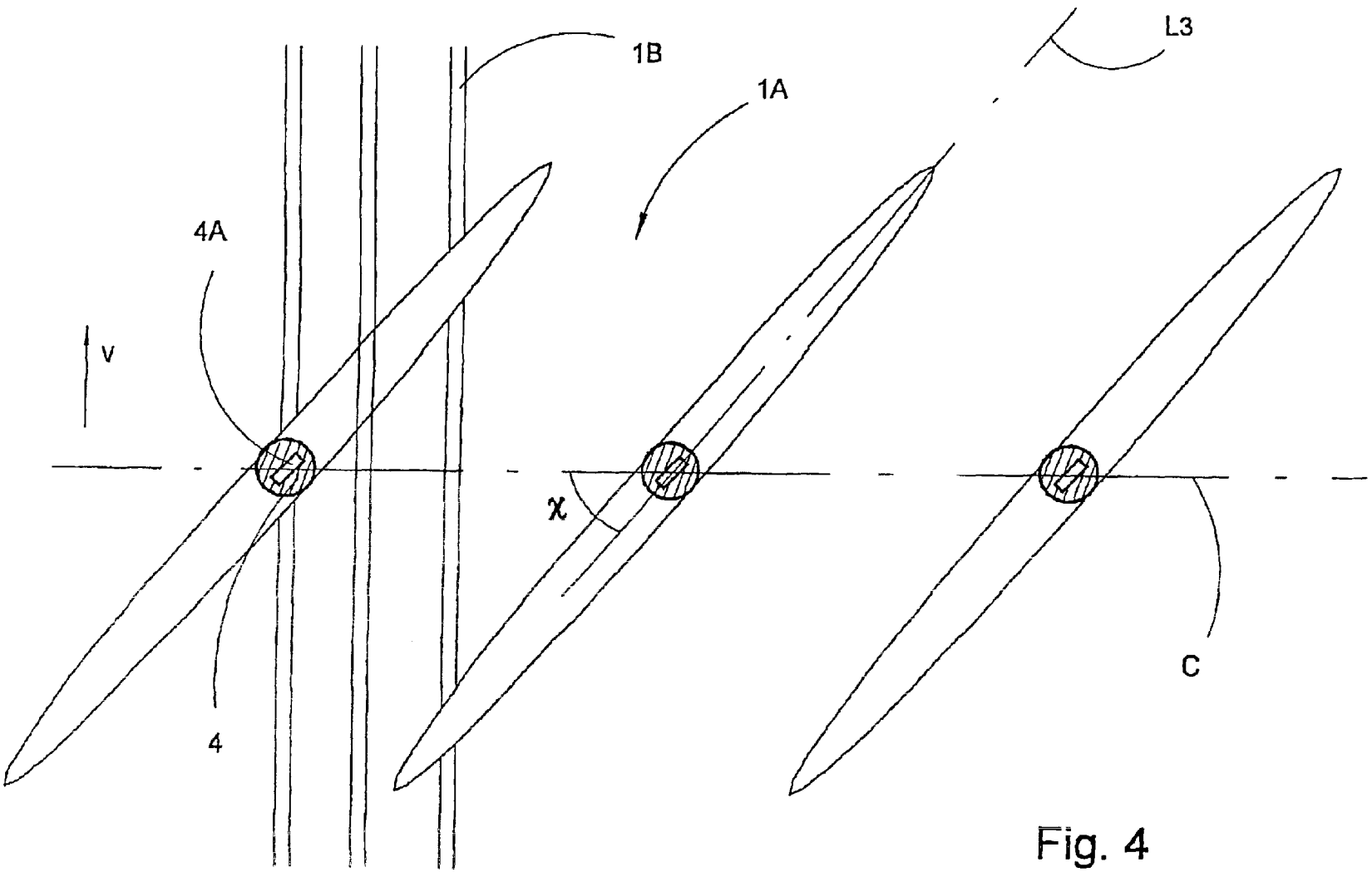
FIG. 4 shows a preferred principle for how sprays according to the invention are directed towards a roll jacket surface.

FIG. 4 shows that the configuration of the mouth 4A is such that the spray jets follow a diverging pattern, by which means they are sprayed along a line L3. The mouth 4A of each spray nozzle 4 is set in such a way that this spray line L3 is at an acute angle in relation to the centre line C of the spray pipe 3. In this way, an overlapping of the spray jets on the roll jacket surface 1A is obtained, without two adjacent spray jets being able to interfere with one another.

Figure 5:
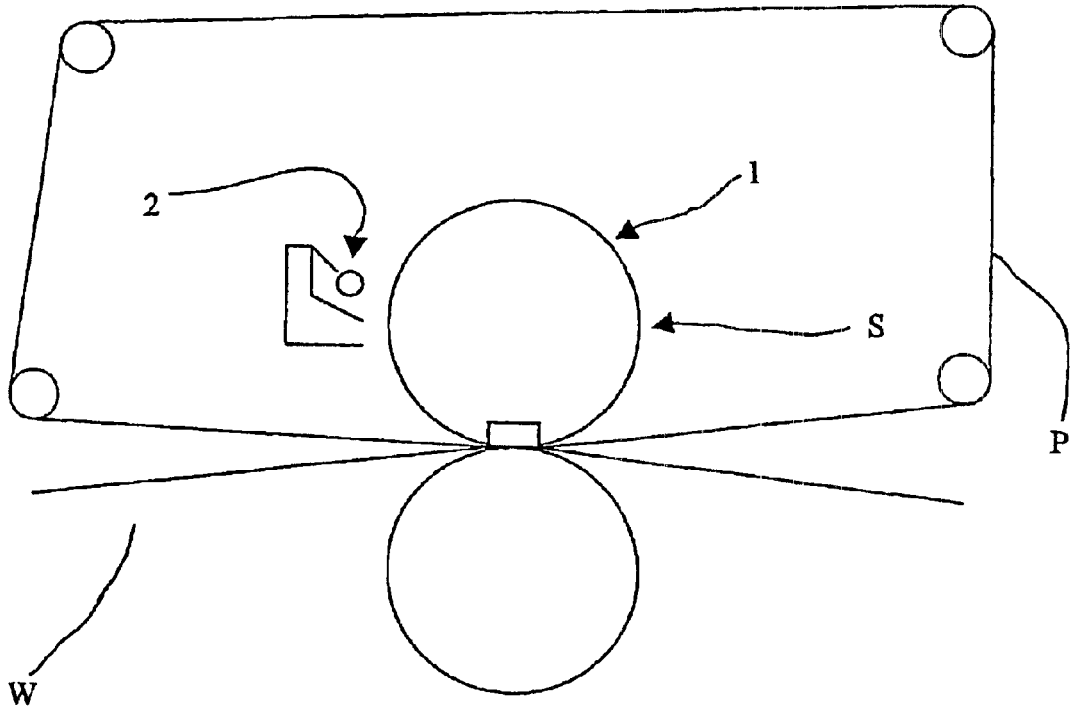
FIG. 5 shows a shoe press device included in a press section in which the device and the method according to the invention are used.

Referring to FIG. 1 and FIG. 5, a shoe press roll S is shown with a shoe which is enclosed by a flexible rotatable roll jacket, which roll jacket has a roll jacket surface 1A. Together with a counter roll M, the shoe press roll S forms a shoe press unit with an extended nip. A press felt P forms a loop around the shoe press roll S, so that the shoe press roll S is located within the felt loop. A spray device 2 is arranged inside the felt loop and close to the roll jacket surface 1A, which spray device is directed towards the roll jacket surface 1A in order to be able to spray a medium onto the roll jacket surface 1A.

Before the device for removing water is started up, the various components involved are adjusted so as to obtain optimum positions and angles. This is preferably done by first adjusting the angle of the whole dewatering device with the aid of clamp connections 18A, 18B around the support part 20. As is shown in the figure, it is preferably adjusted in such a way that the lip device 26 is arranged substantially horizontally. Alternatively, it can be given a certain rearward inclination in order to increase the removal capacity with the aid of gravity. Thereafter, the lip device 26 can be moved so that an optimum gap is formed between the roll jacket surface 1A and the front edge of the lip element 26. This is preferably followed by adjusting the angle α at which the spray is directed towards the roll jacket surface 1A in relation to the normal N of the roll jacket surface. This angle α must be such that the medium which is conveyed with the aid of the spray removes as much liquid as possible from the roll jacket surface 1A and so that the rebounding fluid stream with liquid L2 impacts the lip element 26 in the desired manner. It will be appreciated that this angle α must be able to be adapted because different liquids can have different optimum angles of incidence. In the same way, the nature of the roll jacket surface 1A is also of course important as regards the optimum angle of incidence α, especially if, as in the preferred case, it is a question of removing water from a patterned roll jacket surface 1A.

The angle of incidence α can be adjusted with the aid of the upper clamp connection 13A, 13B by locking the sleeve 15 in the desired angle position β. Preferably however, or as a complement to this, the direction L1 of the spray mouth 4A in relation to the support plate 7 is also adjusted by locking the spray pipe 3 in a different angle position by means of the pipe clamp 6. This is preferably followed by adjusting the distance between the spray mouth 4A and the roll jacket surface 1A by locking the rod 9 in the desired position with the locking screw 11, so that the optimum spray distance is obtained. The distance that is optimum will to a large extent depend on how the spray mouths 4 dispense the medium onto the roll jacket surface 1A. Finally, the height of the mouth gap is adapted to the prevailing vacuum by setting the upper lip-shaped element 26 to a suitable position.

The device for removing water functions in such a way that a medium, for example water, is sprayed via the nozzles 4 at a certain angle of incidence α and at high pressure onto the roll jacket surface 1A, the medium being given a component of movement which is directed counter to the movement of the roll jacket surface 1A. The liquid, usually water, present on the roll jacket surface 1A will then combine with the water which is being conveyed at high kinetic energy, after which they jointly rebound from the flexible roll jacket surface towards the lip element 26. From the lip element 26, the water is conveyed towards the mouth 24 of the container device 22 by means of the latter being under vacuum. The water is then led off from the container via its outlet 23. The arrangement thus permits rapid and effective removal of water from the roll jacket surface 1A, and at the same time, if necessary, cleaning thereof. The method is particularly effective in connection with patterned roll jacket surfaces which cannot always be dewatered (or cleaned) sufficiently well by current methods. In addition, the method has the great advantage that there does not need to be any direct physical contact between the roll jacket surface and the device for removing water, which fact minimizes the risks of wear and risks of damage which exist when a flexible roll jacket is in direct contact with any device. Given that these flexible roll jackets are expensive, this is a not inconsiderable advantage.

By means of the device according to the invention, a press section is also obtained which includes the device according to the invention.

The invention is not limited by what has been described above, and instead it can be varied within the scope of the attached patent claims. It will be appreciated that, among other things, the lip element 26 can advantageously be made of a resilient/flexible material which, in some applications, can advantageously be arranged in direct contact with the roll jacket surface 1A.

What is claimed is:

1. A method of removing water from a surface of a flexible rotatable roll jacket of a shoe press roll in a shoe press unit in a wet section of a paper-making machine, the shoe press unit including a counter roll cooperating with the shoe press roll to form an extended press nip for pressing water from a wet fiber web transported thererthrough by a press felt forming a loop about the shoe press roll, the shoe press roll rotating in a direction of travel so as to advance the press felt and the wet fiber web through the extended press nip, said method comprising:

directing a spray of a liquid medium from a spray device, disposed within the loop and adjacent to the shoe press roll, toward the roll jacket surface and at least partially against the direction of travel of the shoe press roll, the spray being configured such that the liquid medium contacts the roll jacket surface, collects any water pressed from the wet fiber web remaining on the roll jacket surface, and then rebounds from the roll jacket surface; and collecting the rebounded liquid medium and water from the roll jacket surface with a liquid-receiving device disposed adjacent to and upstream, with respect to the direction of travel of the shoe press roll, of the spray device, the liquid-receiving device having a lip element operably engaged therewith and capable of being extended therefrom toward the roll jacket surface so as to direct the rebounded liquid medium and water from the roll jacket surface toward the liquid-receiving device.

2. A method according to claim 1 wherein directing a spray further comprises directing a spray toward the roll jacket surface, at least partially against the direction of travel of the shoe press roll, at an angle of between about 5 degrees and about 85 degrees with respect to a normal of the roll jacket surface.

3. A method according to claim 1 wherein the shoe press roll is rotated at a rotational speed and wherein directing a spray further comprises directing a spray toward the roll jacket surface at an angle, with respect to a normal of the roll jacket surface and at least partially against the direction of travel of the shoe press roll, the angle corresponding to the rotational speed.

4. A method according to claim 3 wherein directing a spray further comprises increasing the angle of the spray as the rotational speed increases.

5. A method according to claim 1 wherein the liquid medium and the water from the roll jacket surface rebound from the roll jacket surface in a direction corresponding to an angle at which the spray is directed toward the roll jacket and the method further comprises redirecting the rebounded liquid medium and water to the liquid-receiving device with the lip element.

6. A method according to claim 5 further comprising adjusting the distance from the lip element to the roll jacket surface.

7. A method according to claim 1 wherein directing a spray further comprises rotating a pipe having at least one spray nozzle fixed thereto, the pipe and the at least one spray nozzle comprising the spray device, so as to direct the spray toward the roll jacket surface.

8. A method according to claim 1 wherein the liquid-receiving device is configured to collect the rebounded liquid medium and water from the roll jacket surface through an opening defined thereby and the method further comprises establishing a pressure within the liquid-receiving device and inside the opening lower than a pressure external to the liquid-receiving device and outside the opening so as to provide a suction for collect the rebounded liquid medium and water.

9. A method according to claim 8 further comprising varying a dimension of the opening.

10. A method according to claim 1 wherein the liquid medium comprises water and directing a spray further comprises directing a spray of water from the spray device toward the roll jacket surface.

11. A method according to claim 1 wherein directing a spray further comprises directing the liquid medium into an elongate pipe, defining a longitudinal axis and arranged substantially parallel to the shoe press roll, and through a plurality of spray nozzles arranged longitudinally along the pipe toward the roll jacket surface.

12. A method according to claim 11 wherein each spray nozzle defines a mouth configured to produce a spray oriented along a jet line and directing the medium further comprises directing the medium through the plurality of spray nozzles, each arranged such that the jet line thereof is disposed at an acute angle with respect to the longitudinal axis of the pipe, toward the roll jacket surface.

13. A method according to claim 11 wherein each spray nozzle defines a month configured to produce a spray oriented along a jet line and directing the medium further comprises directing the medium through the plurality of spray nozzles, each arranged such that the jet line thereof is disposed at an angle of between about 3 degrees and about 30 degrees with respect to the longitudinal axis of the pipe, toward the roll jacket surface.

14. A device adapted to remove water from a surface of a flexible rotatable roll jacket of a shoe press roll in a shoe press unit in a wet section of a paper-making machine, the shoe press unit including a counter roll cooperating with the shoe press roll to form an extended press nip for pressing water from a wet fiber web transported therethrough by a press felt forming a loop about the shoe press roll, the shoe press roll rotating in a direction of travel so as to advance the press felt and the wet fiber web through the extended press nip, said device comprising:

a spray device disposed within the loop and adjacent to the shoe press roll, the spray device being configured to direct a spray of a liquid medium toward the roll jacket surface and at least partially against the direction of travel of the shoe press roll, the spray being configured such that the liquid medium contacts the roll jacket surface, collects any water pressed from the wet fiber web remaining on the roll jacket surface, and then rebounds from the roll jacket surface; and a liquid-receiving device disposed adjacent to and upstream, with respect to the direction of travel of the shoe press roll, of the spray device and having a lip element operably engaged therewith and capable of being extended therefrom toward the roll jacket surface so as to direct the rebounded liquid medium and water from the roll jacket surface toward the liquid-receiving device.

15. A device according to claim 14 wherein the spray device is further configured to direct the spray toward the roll jacket surface, at least partially against the direction of travel of the shoe press roll, at an angle of between about 5 degrees and about 85 degrees with respect to a normal of the roll jacket surface.

16. A device according to claim 14 wherein the shoe press roll is rotated at a rotational speed and wherein the spray device is further configured to direct the spray toward the roll jacket surface at an angle, with respect to a normal of the roll jacket surface and at least partially against the direction of travel of the shoe press roll, corresponding to the rotational speed, the angle of the spray increasing as the rotational speed increases.

17. A device according to claim 14 wherein the lip element is movable with respect to the liquid-receiving device such that the distance from the lip element to the roll jacket surface is adjustable.

18. A device according to claim 14 wherein the spray device further comprises a pipe having at least one spray nozzle fixed thereto, the pipe being rotatable so as to move the at least one spray nozzle to direct the spray toward the roll jacket surface.

19. A device according to claim 14 wherein the liquid-receiving device is configured to collect the rebounded liquid medium and water from the roll jacket surface through an opening defined thereby, the opening extending longitudinally in opposing relation to the roll jacket surface.

20. A device according to claim 19 wherein the liquid-receiving device further comprises a container operably engaged with the opening, the container having a suction applied thereto through an outlet, whereby the applied suction extends through the opening for collecting the rebounded liquid medium and water.

21. A device according to claim 19 wherein the opening of the liquid-receiving device is configured such that a dimension of the opening is capable of being varied.

22. A device according to claim 14 wherein the liquid medium further comprises water.

23. A device according to claim 14 wherein the spray device further comprises an elongate pipe, defining a longitudinal axis and arranged substantially parallel to the shoe press roll, and a plurality of spray nozzles arranged longitudinally along the pipe, the liquid medium being received by the pipe and discharged toward the roll jacket surface through the spray nozzles.

24. A device according to claim 23 wherein each spray nozzle defines a mouth configured to produce a spray oriented along a jet line and each spray nozzle is arranged such that the jet line thereof is disposed at an angle of between about 3 degrees and about 30 degrees with respect to the longitudinal axis of the pipe.

25. A press section of a paper-making machine, comprising:

a shoe press unit including a shoe press roll having a flexible rotatable roll jacket and a counter roll cooperating with the shoe press roll to form an extended press nip adapted to press water from a wet fiber web transported therethrough by a press felt forming a loop about the shoe press roll, the shoe press roll rotating in a direction of travel so as to advance the press felt and die wet fiber web through the extended press nip; and a device disposed within the loop and adapted to remove water from a surface of the roll jacket, the device comprising:

a spray device dispose adjacent to the shoe press roll, the spray device being configured to direct a spray of a liquid medium toward the roll jacket surface and at least partially against the direction of travel of the shoe press roll, the spray being configured such that the liquid medium contacts the roll jacket surface, collects any water pressed from the wet fiber web remaining on the roll jacket surface, and then rebounds from the roll jacket surface; and a liquid-receiving device disposed adjacent to and upstream, with respect to the direction of travel of the shoe press roll, of the spray device and having a lip element operably engaged therewith and capable being extended therefrom toward the roll jacket surface so as to direct the rebounded liquid medium and water from the roll jacket surface toward the liquid-receiving device.

26. A press section according to claim 25 wherein the spray device is further configured to direct the spray toward the roll jacket surface, at least partially against the direction of travel of the shoe press roll, at an angle of between about 5 degrees and about 85 degrees with respect to a normal of the roll jacket surface.

27. A press section according to claim 25 wherein the shoe press roll is rotated at a rotational speed and wherein the spray device is further configured to direct the spray toward the roll jacket surface at an angle, with respect to a normal of the roll jacket surface and at least partially against the direction of travel of the shoe press roll, corresponding to the rotational speed, the angle of the spray increasing as the rotational speed increases.

28. A press section according to claim 25 wherein the lip element is movable with respect to the liquid-receiving device such that the distance from the lip element to the roll jacket surface is adjustable.

29. A press section according to claim 25 wherein the spray device further comprises a pipe having least one spray nozzle fixed thereto, the pipe being rotatable so as to move the at least one spray nozzle to direct the spray toward the roll jacket surface.

30. A press section according to claim 25 wherein the liquid-receiving device is configured to collect the rebounded liquid medium and water from the roll jacket surface through an opening defined thereby, the opening extending longitudinally in opposing relation to the roll jacket surface.

31. A press section according to claim 30 wherein the liquid-receiving device further comprises a container operably engaged with the opening, the container having a suction applied thereto through an outlet, whereby the applied suction extends through the opening for collecting the rebounded liquid medium and water.

32. A press section according to claim 30 wherein the opening of the liquid-receiving device is configured such that a dimension of the opening is capable of being varied.

33. A press section according to claim 25 wherein the liquid medium further comprises water.

34. A press section according to claim 25 wherein the spray device further comprises an elongate pipe, defining a longitudinal axis and arranged substantially parallel to the shoe press roll, and a plurality of spray nozzles arranged longitudinally along the pipe, the liquid medium being received by the pipe and discharged toward the roll jacket surface through the spray nozzles.

35. A press section according to claim 34 wherein each spray nozzle defines a mouth configured to produce a spray oriented along a jet line and each spray nozzle is arranged such that the jet line thereof is disposed at an angle of between about 3 degrees and about 30 degrees with respect to the longitudinal axis of the pipe.

* * * * *

UNITED STATES PATENT AND TRADEMARK OFFICE

CERTIFICATE OF CORRECTION

PATENT NO. : 6,899,792 B2
DATED : May 31, 2005
INVENTOR(S) : Hallberg

It is certified that error appears in the above-identified patent and that said Letters Patent is hereby corrected as shown below:

Title page,
Item [60], Related U.S. Application Data, "60/273,368" should read -- 60/273,367 --;

Column 1,
Line 6, "Nov." should read -- March --;

Column 8,
Line 41, "die" should read -- the --.

Signed and Sealed this

Twenty-third Day of August, 2005

JON W. DUDAS
*Director of the United States Patent and Trademark Office*